United States Patent [19]

Theurer et al.

[11] Patent Number: 4,922,828

[45] Date of Patent: May 8, 1990

[54] BALLAST TAMPING TOOL

[75] Inventors: Josef Theurer, Vienna; Johann Hansmann, Klosterneuburg, both of Austria

[73] Assignee: Franz Plasser Bahnbaumaschinen-Industriegesellschaft m.b.H., Vienna, Austria

[21] Appl. No.: 210,921

[22] Filed: Jun. 24, 1988

[30] Foreign Application Priority Data

Nov. 26, 1987 [EP] European Pat. Off. ..... 87890274.1

[51] Int. Cl.[5] ..... E01B 27/16

[52] U.S. Cl. ..... 104/10

[58] Field of Search ..... 104/10, 12–14; 37/142 R, 141 T; 172/713, 772, 772.5; 403/333, 334, 361

[56] References Cited

U.S. PATENT DOCUMENTS

| | | | |
|---|---|---|---|
| 376,565 | 1/1888 | Waldron et al. | 104/13 |
| 2,666,272 | 1/1954 | Everett | 37/142 R |
| 2,990,633 | 7/1961 | Buskirk | 37/142 R |
| 3,729,055 | 4/1973 | Burridge | 104/10 X |
| 3,826,025 | 7/1974 | Elliott | 104/12 X |
| 4,062,291 | 12/1977 | Vick et al. | 104/10 |
| 4,167,141 | 9/1979 | Haywood | 104/10 |
| 4,606,275 | 8/1986 | Grant | 104/10 |

FOREIGN PATENT DOCUMENTS

| | | |
|---|---|---|
| 378797 | 2/1985 | Austria . |
| 2849951 | 5/1980 | Fed. Rep. of Germany . |
| 2723551 | 9/1980 | Fed. Rep. of Germany . |

*Primary Examiner*—Margaret A. Focarino
*Assistant Examiner*—Hamlin Williams
*Attorney, Agent, or Firm*—Kurt Kelman

[57] ABSTRACT

A ballast tamping tool for attachment to a reciprocating tamping drive of a ballast tamping machine comprises a shaft having an upper end affixed to the tamping drive and a tamping blade detachably mounted on a lower end of the shaft. A plug-in, form-fitting connection detachably connects the tamping blade to a lower end of the shaft, the detachable connection defining a recess behind the rear surface of the tamping blade and comprising a plug projecting from the lower shaft end and being offset therefrom by a step to form a shoulder, the upper tamping blade edge extending at least partially along, and axially adjacent, the shoulder, and a connecting part at the rear tamping blade surface form-fittingly connecting the tamping blade to the plug.

10 Claims, 1 Drawing Sheet

BALLAST TAMPING TOOL

BACKGROUND OF THE INVENTION (1) Field of the Invention

The present invention relates to a ballast tamping tool for attachment to a reciprocating tamping drive of a ballast tamping machine, which comprises a shaft having an axis and an upper end affixed to the tamping drive, a tamping blade detachably mounted on a lower end of the shaft, the tamping blade having a ballast tamping front surface, an opposite rear surface and an upper edge between the surfaces, and a plug-in, form-fitting connection for detachably connecting the tamping blade to a lower end of the shaft and defining a recess. The plug-in connection comprises a plug projecting from the lower shaft end and a connecting part at the rear tamping blade surface form-fittingly connecting the tamping blade to the plug.

Ballast tamping tools are used in the tamping heads of mobile tampers for railroad track maintenance or rehabilitation and such tamping tools are affixed to reciprocatory and vibratory drives, and the tools are immersed in the cribs of the ballast bed to tamp ballast under adjacent ties. The immersion of the tamping tools into the ballast and their reciprocation and vibration in the ballast during each tamping cycle subjects the tools to considerable stresses due to the resistance the tools encounter during their immersion, particularly in partially encrusted ballast beds, and the pressures to which the tools are subjected as they compact the ballast under the ties. This causes the tamping blades to be worn very rapidly, and the tamping tools must be removed from their holders on the tamping head drives after a certain operating time to repair the tamping blades. Since the tamping tools are made of metal, they are quite heavy and their replacement, therefore, is quite cumbersome and time-consuming, particularly since the usual tamping heads at each track rail have from four to eight tamping tools, thus requiring the dismounting of 8 to 16 tools on machines designed for the tamping of a single tie during each tamping cycle and up to 32 tamping tools on machines designed for tamping two adjacent ties simultaneously. In addition to the cumbersome and time-consuming dismounting and mounting of the tamping tools, the repair of the tamping blades itself involves expensive and time-consuming work, which furthermore can be repeated only a few times, after which the tamping blade quality is too poor for effective use of the tamping blades. Therefore, as pointed out in the introductory paragraph hereinabove, it has been proposed to use ballast tamping tools with detachable tamping blades whose detachment from, and attachment to, the tool shafts is relatively simple and can be effected rapidly with relatively little effort. (2) Description of the Prior Art German Pat. No. 2,723,551, published Sept. 25, 1980, discloses a ballast tamping tool with a separable tool shaft and tamping blade, the tamping blade having an affixing stub or bracket forming a plug-in connection with the lower end of the tool shaft. In one embodiment, the tamping blade stub extends into a form-fitting recess in the lower tool shaft end, and in another embodiment, the tamping blade bracket has a recess into which a plug projecting from the lower shaft end form-fittingly fits. The tamping blade stub or bracket and the lower shaft end or plug have bores which are aligned when the tamping blade and shaft are plugged together, and the aligned bores receive a radially yielding connecting element. The tamping blade stub or bracket extend far above the upper edge of the tamping blade so that the plug-in connection is relatively weak and subject to breakage under the operating stresses to which the tool is subjected.

In an effort to overcome this disadvantage, German patent application No. 2,849,951, published May 29, 1980, proposes a two-part ballast tamping tool with a plug-in connection which comprises a first connecting part extending almost to the middle of the shaft and a second connecting part extending from the upper edge of the tamping blade, the two connecting parts interlocking in a complex manner so that the tool is difficult to manufacture and accordingly uneconomical. Furthermore, the radially yielding clamping sleeve or the clamping bolt used to connect the two parts often jams during assembly or disassembly.

U.S. Pat. No. 3,729,055, dated Apr. 24, 1973, discloses a two-part ballast tamping tool wherein a conical projection extends from the upper edge of the tamping blade and is received in a corresponding conical recess in the lower end of the shaft. In this way, the tamping blade may be plugged into the shaft and the two parts are fixed in position by a lock screw or bolt. While this structure is very simple, the connection cannot absorb the powerful forces to which the tool is subjected, particularly a rotation of the tamping blade with respect to the shaft. More particularly, the diameter of the conical projection is too small to prevent breakage of the tool at the connection during the tamping operation.

Austrian Pat. No. 378,797, published Feb. 15, 1985, also discloses a ballast tamping tool with a tamping blade which may be detached from the tool shaft. The lower shaft end of this tool has a trapezoidal cross section and fits into a corresponding tamping blade recess defined between two flanges integral with the tamping blade and inclined with respect to each other. This trapezoidally form-fitting plug-in connection is supposed to provide a friction fit sufficient to hold the two tool parts together without any additional connecting elements. However, in actual tamping operations it has been found that the tamping blade often remains in the ballast and is detached from the shaft when the tamping tools are raised at the end of a tamping cycle. In addition, the preparation of the trapezoidal lower shaft end for a form-fit in the recess defined between the two tamping blade flanges requires special surfacing, which is expensive and, therefore, makes the tools uneconomical. Actually, a similar but simpler trapezoidal plug-in connection between a tamping blade and a tool shaft was proposed in the hand tamping tool disclosed in U.S. Pat. No. 376,565, dated Jan. 17, 1888.

SUMMARY OF THE INVENTION

It is the primary object of this invention to improve a ballast tamping tool of the type described in the introductory paragraph of the specification so as to provide a simple, yet robust ballast tamping tool which may be readily and rapidly assembled and disassembled while being capable of absorbing the forces encountered during tamping without breaking the plug-in connection.

The above and other objects and advantages are accomplished with a plug-in, form-fitting connection for detachably connecting the tamping blade to the lower end of the shaft, the detachable connection comprising a plug projecting from the lower shaft end, the plug having a conical sector shape and an end face, and the plug being offset from the lower shaft end by a step to form a shoulder, the upper tamping blade edge extending at least partially along, and axially adjacent, the shoulder, and a connecting part at the rear tamping blade surface form-fittingly connecting the tamping blade to the plug, the connecting part being a socket having the shape of a conical sector defining a recess of a shape conforming to that of the plug and having a parabolic end face contacting the rear surface of the tamping blade, and the end faces extending substantially parallel to the rear tamping blade surface.

The following advantageous results are obtained with such a plug-in connection in which a step or shoulder is formed between the lower end of the tamping tool shaft and the plug in the direction of the operating direction of the tool, and the upper tamping blade edge comes to rest alongside this step or shoulder when the plug and connecting part are plugged together:

The connection is robust, yet simple, and the forces acting on the tamping blade are transmitted directly and substantially in the same vertical direction to the tool shaft when the tamping tool is immersed in the ballast. This robust and simple plug-in connection also prevents any rotation of the tamping blade with respect to the tool shaft. Depending on the profile of the shaft, the tamping blade may extend parallel, or slightly inclined, to the shaft but, in any case, the upper tamping blade edge will always advantageous protrude partially from the shaft while the tamping blade has a thickness to assure that most of the tamping blade will be seated within a recess behind the step or shoulder. In this way, the size of the hole the tamping blade leaves in the ballast upon withdrawal therefrom will be reduced and no sizable ballast rocks will be pulled up with the tamping tool as it is raised out of the ballast bed after tamping.

BRIEF DESCRIPTION OF THE DRAWING

The above and other objects, features and advantages of the invention will become more apparent from the following detailed description of certain now preferred embodiments thereof, taken in conjunction with the accompanying drawing wherein.

DESCRIPTION OF THE PREFERRED EMBODIMENTS

Figure 1:
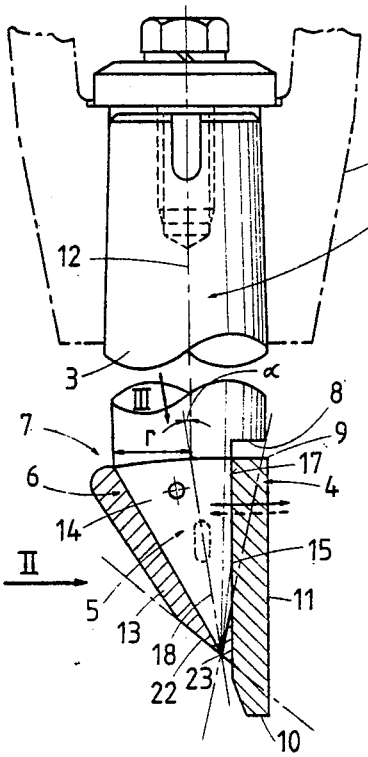
FIG. 1 is a fragmentary side elevational view of one embodiment of a ballast tamping tool for attachment to a reciprocating tamping drive of a ballast tamping machine, showing the tamping blade and connecting part of the plug-in connection in vertical section.
Figure 2:
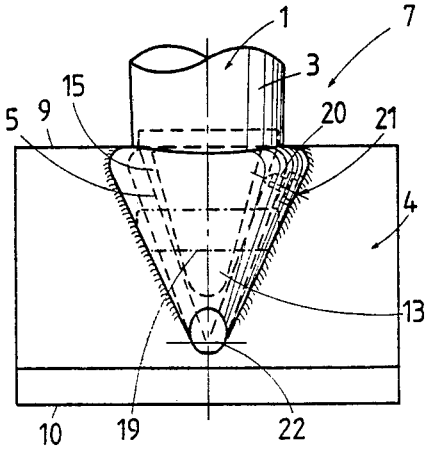
FIG. 2 is an end view of the connection in the direction of arrow II of FIG. 1.
Figure 3:
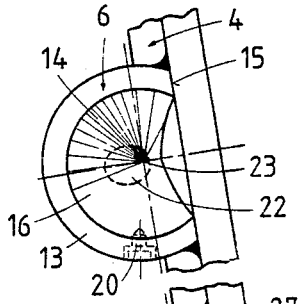
FIG. 3 is a top view of the tamping blade detached from the plug, as seen in the direction of arrow III of FIG. 1.

Referring now to the drawing and first to FIGS. 1 to 3, FIG. 1 illustrates ballast tamping tool 1 for attachment to a reciprocating tamping drive of a ballast tamping machine (not shown). The ballast tamping tool comprises shaft 3 having axis 12 and an upper end affixed to holder 2 (shown in phantom lines) of the tamping drive which, in a well known manner, vibrates the tool and reciprocates the same in a direction indicated by the two small arrows shown in full and broken lines in FIG. 1 at tamping blade 4. The tamping blade is detachably mounted on a lower end of shaft 3 and has ballast tamping front surface 11, which is in pressure contact with the ballast during tamping, an opposite rear surface and upper edge 9 between the surfaces. The lower shaft end is substantially cylindrical and has a radius r. Plug-in, form-fitting connection 7 detachably connects tamping blade 4 to the lower shaft end. According to the present invention, connection 7 defines a recess behind the rear tamping blade surface and comprises plug 5 projecting from the lower shaft end and being offset therefrom by a step to form shoulder 8, upper tamping blade edge 9 extending at least partially along, and axially adjacent, shoulder 8. Connecting part 6 at the rear tamping blade surface form-fittingly connects tamping blade 4 to plug 5 in a friction fit.

As shown in the drawing, tamping blade 4 has a blunt wedge-shaped lower edge 10 opposite upper edge 9 and plug-in connection 7 extends substantially the entire height of the tamping blade. Ballast tamping front surface 11 of tamping blade 4 extends substantially parallel to shaft axis 12. Connecting part 6 of this plug-in connection is a socket having the shape of a conical sector 13 defining conical recess 14 and having parabolic end face 15 contacting the rear surface of tamping blade 4. The parabolic end face of the socket is welded to the rear tamping blade surface along its outer rim, as clearly shown in FIG. 3. Plug 5 has a conical sector shape conforming to the shape of conical socket recess 14 and end face 17 extending substantially parallel to the rear tamping blade surface and in contact therewith. The wedge shape of the lower tamping blade end facilitates the penetration of tamping tool 1 when it is immersed in the ballast. The extension of the plug-in connection substantially over the entire height of the tamping blade makes the connection very robust and capable of absorbing considerable pressures without breaking. The parallel extension of the tamping blade to the shaft axis assures a relatively easy immersion and withdrawal of the tool with a minimum of friction, particularly when working in encrusted ballast. The described and illustrated conical plug-in connection provides a very simple connection for rapid assembly of the tool and detachment of the tamping blade from the tool shaft, and despite the two-part tool structure, the vibratory and reciprocatory forces to which the tamping tool is subjected during operation will be readily transferred between the tamping blade and tool shaft while the tamping blade will be held on the shaft against rotation with respect thereto. This structure also permits the largest possible tool shaft radius to enhance the sturdiness of the tool and the substantially centered arrangement of the conical connecting part and plug enables the connecting part to enclose the plug evenly. Such a plug-in connection has the added advantage that the plug and the socket may be machined, for example rolled, ground or otherwise shaped, to impart a pre-tensioned fit between the plug and the socket so that a particularly tight form-fit will be produced therebetween.

In the illustrated embodiment, parabolic socket end face 15 contacting the rear tamping blade surface in a plane extending substantially parallel to the shaft axis extends at a distance from shaft axis 12 corresponding to about one half to three quarters of radius r of the lower cylindrical shaft end. Conical sector 13 has an axis 18 enclosing an angle $\alpha$ of about 5° to 15°, preferably 10°, with shaft axis 12, conical sector axis 18 being inclined with respect to the rear tamping blade surface. This arrangement and dimensioning of the connection has been found advantageous in the manufacture and also assures a particularly break-resistant connection capable of absorbing even peak pressures because the conically tapered plug end of the shaft still has three quarters to seven eighths of the full shaft diameter and thus provides a robust plug for the connection. The inclined arrangement of the conical socket to the tamping blade enhances the wedging effect of the tool during immersion, particularly into encrusted ballast, and this effect is further increased if socket 13 has a flattened lower face 22 inclined with respect to the tamping blade, as shown in FIG. 1.

Figure 5:
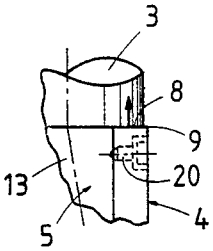
FIG. 5 is a fragmentary side view showing a detail of a plug-in connection.

As particularly shown in FIGS. 2 and 3, a connecting element may detachably connect plug 5 to connecting part 6, this connecting element being a wedge 19 or a countersunk pin or bolt 20. Conical socket 13 of circular cross section tapers to point 23 which receives the point of conical plug 5. As shown in FIG. 3, bolt 20 is threaded into a threaded radial bore in socket 13 and its conical end engages in a conical notch in plug 5. If such a connecting element is found to be desirable, the illustrated detachable elements will provide particularly simple and effective detachable connections. As appears from FIG. 1, tamping blade 4 has a thickness slightly exceeding the depth of the step in plug 5 so that upper edge 9 of the tamping blade projects laterally a little from shoulder 8. In the embodiment illustrated in FIG. 5, upper tamping blade edge 9 abuts shoulder 8. This abutting relationship will assure direct transmission of the vertical forces encountered during immersion of ballast tamping tool 1 from tamping blade 4 to tool shaft 3 and relieve the pressure on plug-in connection 7.

Metallic tamping blades 4 are produced by casting, forging or like manufacturing processes and it is preferred to manufacture the tamping blades and conical sockets 13 separately, the finished sockets being then welded to tamping blades 4. Conical sockets 13 and plugs 5 are suitably machined to provide a form fit between conical surface 16 of socket recess 14 and the conical surface of plug 5. Subsequently, the conical sockets are machined to provide ellipsoidal flattened lower face 22 and parabolic end face 15 on the sockets. The parabolic end face of finished socket 13 is then welded to the rear tamping blade surface. The lower end of tool shaft 3 forms plug 5 and is machined to form therein shoulder 8 and flat surface 17 extending parallel to shaft axis 12. If a detachable connecting element is to be used for the plug-in connection, the plug may be further machined to provide a recess for receiving connecting wedge 19 and/or a notch for receiving connecting bolt 20.

After tamping blade 4 has been worn out, detachable connecting element 19 and/or 20 is detached. The tamping blade is then detached from the tool shaft by hammer blows on laterally projecting upper taping blade edge 9 whereby the tamping blade with its connecting socket 13 is removed from plug 5 to which it has been connected by a form-fitting friction fit. A new tamping blade can then be connected to the tool shaft by plugging socket 13 onto plug 5, light hammer blows against blunt lower edge 10 of the tamping blade being optionally used to assure a tight form fit between the socket and plug. If used, connecting elements 19 and/or 20 are then applied. The work of assembling and disassembling the tamping blade may be effected while tool shaft 3 remains affixed to holder 2. Planar surface 17 of plug 5 in contact with the rear tamping blade surface automatically assures a proper positioning of tamping blade 4 with respect to tool shaft 3 during assembly. It will also prevent any rotation of the tamping blade with respect to the tool shaft about shaft axis 12 and assure the absorption of considerable pressure and torsion forces. With connecting socket 13 enclosing plug 5 over a large surface, all operating forces will be adequately transmitted between the shaft and tamping blade of the tool.

Figure 4:
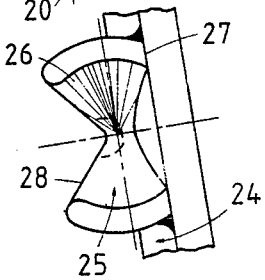
FIG. 4 is a like top view of a modified embodiment of the connecting part.

The modified embodiment of FIG. 4 differs from the above-described embodiment only in that conical sector 26 of connecting part 25 of tamping blade 24 has parabolic cut-out 28 opposite parabolic end face 27 and remote from the rear tamping blade surface. Such a plug-in connection will penetrate even more readily into the ballast, and the two parts of conical sector 26 may be machined with even greater precision so that the connection may be plugged together with a very secure friction fit preventing the detachment of the socket from the plug during operation.

What is claimed is:

1. A ballast tamping tool for attachment to a reciprocating tamping drive of a ballast tamping machine, which comprises (a) a shaft having an axis and an upper end affixed to the tamping drive, (b) a tamping blade detachably mounted on a lower end of the shaft, the tamping blade having (1) a ballast tamping front surface, (2) an opposite rear surface, and (3) an upper edge between the surfaces, and (c) a plug-in, form-fitting connection for detachably connecting the tamping blade to the lower end of the shaft, the detachable connection comprising (1) a plug projecting from the lower shaft end, the plug having a conical sector shape and an end face, and the plug being offset from the lower shaft end by a step to form a shoulder, the upper tamping blade edge extending at least partially along, and axially adjacent, the shoulder, and (2) a connecting part at the rear tamping blade surface form-fittingly connecting the tamping blade to the plug, the connecting part being a socket having the shape of a conical sector defining a recess of a shape conforming to that of the plug and having a parabolic end face contacting the rear surface of the tamping blade, and the end faces extending substantially parallel to the rear tamping blade surface.

2. The ballast tamping tool of claim 1, wherein the tamping blade has a wedge-shaped lower edge opposite the upper edge and the plug-in connection extends substantially the entire height of the tamping blade.

3. The ballast tamping tool of claim 1, wherein the ballast tamping front surface of the tamping blade extends substantially parallel to the shaft axis.

4. The ballast tamping tool of claim 1, wherein the parabolic socket end face is welded to the rear tamping blade surface.

5. The ballast tamping tool of claim 1, wherein the lower shaft end is substantially cylindrical and the parabolic socket end face contacting the rear tamping blade surface extends at a distance from the shaft axis corresponding to about one half to three quarters of the radius of the lower cylindrical shaft end.

6. The ballast tamping tool of claim 1, wherein the conical sector has an axis enclosing an angle of about ° to 15° with the shaft axis, the conical sector axis being inclined with respect to the rear tamping blade surface.

7. The ballast tamping tool of claim 1, wherein the parabolic socket end face is welded to the rear tamping blade surface, and the upper tamping blade edge abuts the shoulder and projects laterally therefrom.

8. The ballast tamping tool of claim 1, wherein the conical sector has a parabolic cut-out diametrically opposite the parabolic end face and remote from the rear tamping blade surface.

9. The ballast tamping tool of claim 1, wherein the plug and the socket are machined to impart a pre-tensioned fit between the plug and the socket in the plug-in connection.

10. The ballast tamping tool of claim 1, further comprising a connecting element detachably connecting the plug to the connecting part.

* * * * *